United States Patent [19]

Dennis

[11] 4,394,549

[45] Jul. 19, 1983

[54] ELECTRICAL CONNECTOR

[75] Inventor: Richard D. Dennis, Bridgeport, N.Y.

[73] Assignee: Carrier Corporation, Syracuse, N.Y.

[21] Appl. No.: 307,122

[22] Filed: Sep. 30, 1981

[51] Int. Cl.[3] ..... H01H 15/10

[52] U.S. Cl. ..... 200/16 E; 200/153 H; 339/32 M

[58] Field of Search ..... 200/16 E, 51 R, 51.07, 200/162, 153 H, 163; 339/32 M, 32 R, 31 M, 75 M

[56] References Cited

U.S. PATENT DOCUMENTS

| | | | |
|---|---|---|---|
| 632,076 | 8/1899 | Wells | 200/16 E |
| 1,746,911 | 2/1930 | Smart | 200/16 E |
| 2,510,944 | 6/1950 | Auerbach | 339/66 M |
| 3,187,120 | 6/1965 | Akst | 200/16 E |
| 3,280,275 | 10/1966 | Sheffield et al. | 200/16 E |
| 3,377,444 | 4/1968 | Doubt | 200/16 E |
| 3,534,320 | 10/1970 | Rushing | 339/75 M |
| 3,569,906 | 3/1971 | Cohen | 339/75 M |
| 3,903,384 | 9/1975 | De Visser et al. | 200/16 E |

FOREIGN PATENT DOCUMENTS

| | | | |
|---|---|---|---|
| 560066 | 3/1944 | United Kingdom | 200/16 E |
| 1151833 | 5/1969 | United Kingdom . | |

OTHER PUBLICATIONS

Pittwood, Zurowski; Card-To-Board Pluggable Contact System, Jan. 1970, IBM Technical Disclosure Bulletin, vol. 12, No. 8, p. 1210.

*Primary Examiner*—John W. Shepperd

*Attorney, Agent, or Firm*—Donald F. Daley; David J. Zobkiw

[57] ABSTRACT

An electrical connector comprising a plug, a socket, and a switching mechanism. The plug includes a plurality of outwardly extending blades defining parallel blade axes, and the socket defines a plurality of receptacles for receiving the blades. The socket has two longitudinally spaced positions for forming two different electrically conductive circuits with the plug. The switching mechanism is provided for moving the socket along the blades axes away from the first socket position, then along the longitudinal axis of the plug, and then back along the blade axes toward and into the second socket position.

9 Claims, 12 Drawing Figures

ELECTRICAL CONNECTOR

BACKGROUND OF THE INVENTION

This invention generally relates to electrical connectors, and more specifically to a multi-position electrical connector.

Multi-position electrical connectors or switches are often used to alter the current flow path through an electric apparatus or device and simultaneously to connect the apparatus to one of a plurality of power supplies. For example, many electric motors may be driven by different power supplies having different electric voltages such as either a 220 volt power source or a 440 volt power source. Typically, these motors include multiple windings, where each motor winding has a pair of winding sections. A multi-position electrical connector or switch is used to connect the sections of individual windings in series when the motor is connected to a first power source such as the 440 volt power supply, and to connect the sections of individual windings in parallel when the motor is connected to a second power supply such as the 220 volt power source.

Motors of the general type described above are often used with refrigeration machines employed to cool or condition the interior of a transportable container unit. To elaborate, during the course of its lifetime, a transport container unit may pass through numerous countries and regions in the world. In certain areas the principle—often the only—electric energy source provides a 440 volt current, while in other areas the primary—and again often the only—electric energy source provides a 220 volt current. Consequently, refrigeration machines for transport container units are often provided with an electric motor which may be driven by either of these energy sources.

Heretofore, rotary switches, wherein rotation of a knob or dial moves a plurality of conductive members into and out of electric engagement with other conductive members, have usually been used to switch the motor winding sections between series and parallel operation and to connect the motor to a selected one of a plurality of power supplies. Rotary switches, however, typically include a relatively large number of parts such as springs, pins, and detents in order to insure that, as the switch changes positions, the appropriate conductive members are brought into secure electrical contact. Because of this large number of parts, rotary switches are relatively expensive to produce; and as a result of this, efforts have been made to design an electrical connector or switch which will achieve the same results as a rotary switch but which is less expensive to manufacture and assemble.

These efforts have produced a relatively simple and inexpensive, unique electrical connector. The connector comprises a plug including a plurality of blades and a socket defining a plurality of receptacles for receiving the blades. The socket has two longitudinally spaced apart, electrically engaging positions. In the first position, the plug and socket engage to connect sections of individual motor windings of a motor in parallel and to connect the motor to a first voltage source. In the second position, the plug and socket engage to connect the sections of individual motor windings in series and to connect the motor to a second voltage source. When the plug and socket engage, clips or grips secured within the receptacles of the socket securely engage individual blades of the plug to hold the plug and socket together, and preferably the plug and socket are tightly held together. While this essentially eliminates the possibility that the plug and socket will accidently or inadvertently come apart, it also makes it difficult to move the socket between its two positions, especially solely by hand.

SUMMARY OF THE INVENTION

In view of the above, an object of this invention is to provide an electrical connector, including a socket having two longitudinally spaced apart, electrically engaged positions, with mechanical means for moving the socket between its two positions.

Another object of the present invention is to provide a plug and socket type electrical connector with switching means for moving the socket away from a first connected position along the axes of the plug blades, then along the longitudinal axis of the plug, and then back along the axes of the plug blades into a second connected position.

A further object of this invention is to provide an electrical connector having a longitudinally extending plug and socket with means for maintaining the longitudinal axes of the plug and socket substantially parallel as the socket moves between two, longitudinally spaced apart positions.

These and other objects are attained with an electrical connector comprising a first connector member, a second connector member, and switching means. The second connector member has two longitudinally spaced positions for forming two different, electrically conductive circuits with the first connector member. A selected one of the first and second connector members include a plurality of outwardly extending blades defining parallel blade axes, and the other one of the connector members defines a plurality of receptacles receiving the blades and defining receptacle axes parallel to the blade axes. The switching means is secured to the first connector member and is provided for moving the second connector member along the blade axes away from the first position, then along the longitudinal axis of the first connector member, and then along the blade axes toward and into the second position.

A BRIEF DESCRIPTION OF THE DRAWINGS

Figure 8:
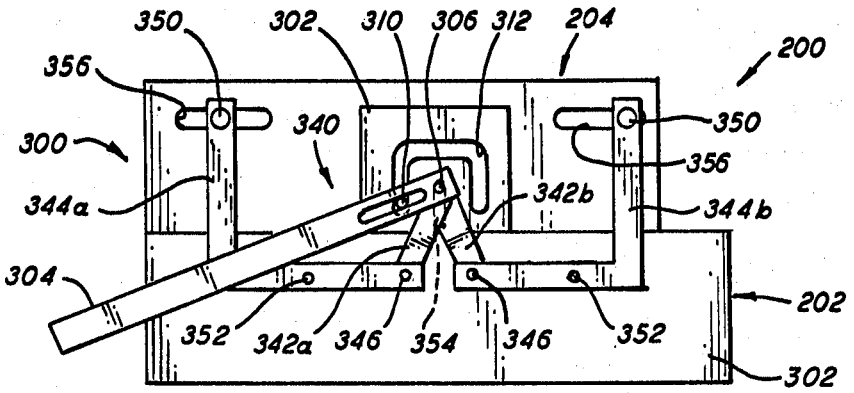
Figure 9:
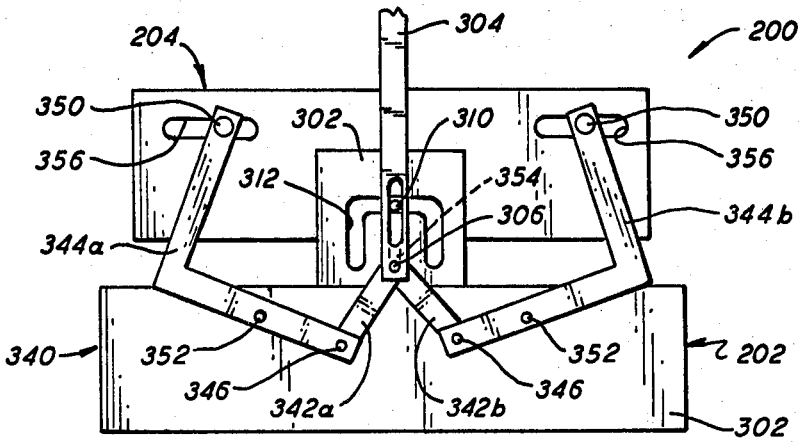
Figure 10:
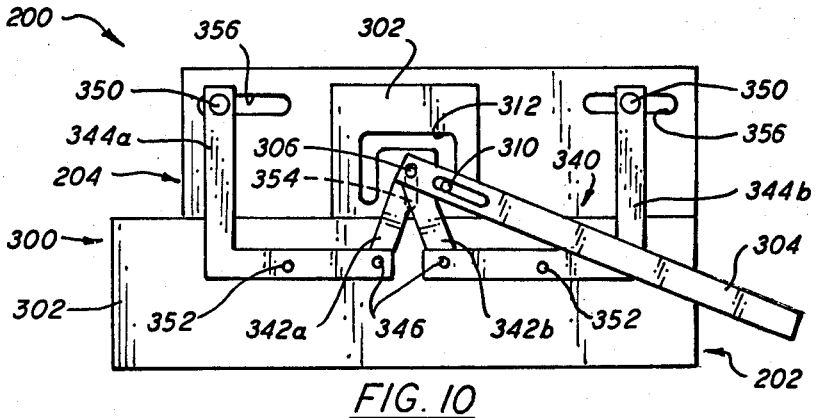
Figure 11:
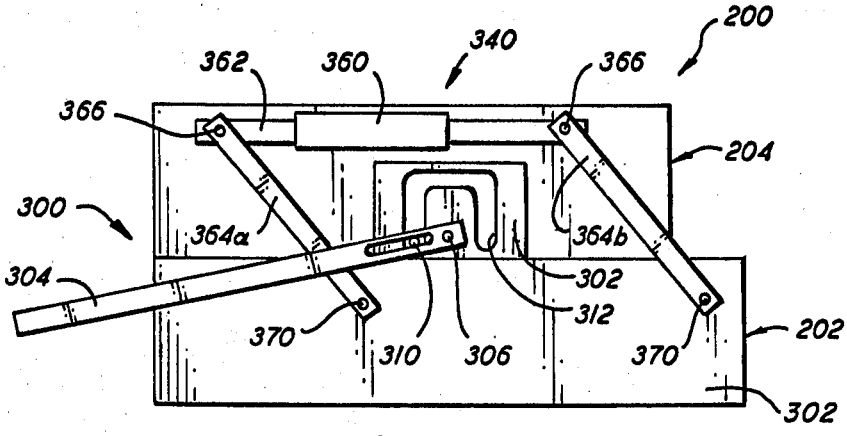
Figure 12:
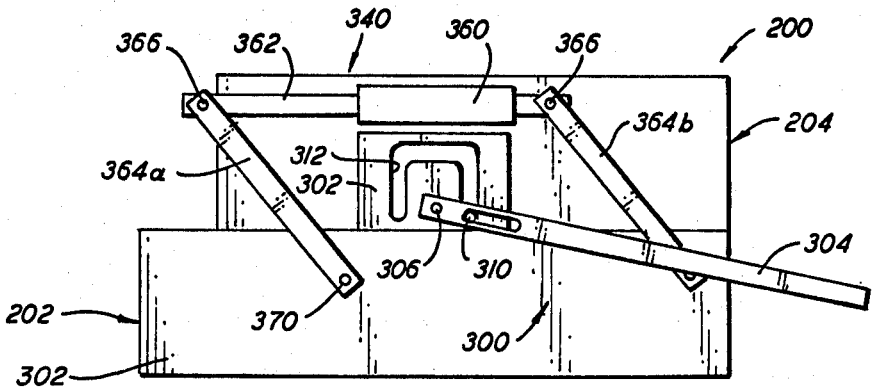

FIGS. 8, 9, and 10 are side views of an embodiment of the electrical connector including a second type of switching means for moving the socket between the first and second positions thereof; and FIGS. 11 and 12 are side views of an embodiment of the electrical connector including a third type of switching means for moving the socket between the first and second positions thereof.

A DETAILED DESCRIPTION OF THE PREFERRED EMBODIMENT

It should be made clear that the present invention discussed in detail below, although described in terms of a plug including a plurality of blades and a socket defining a plurality of receptacles for receiving the blades, may, with modifications easily made by those of ordinary skill in the art, be embodied with a socket including a plurality of blades and a plug defining a plurality of receptacles for receiving those blades. Thus, as used herein, including the claims, the terms "blades" and "receptacles" are defined as interchangeable.

Figure 1:
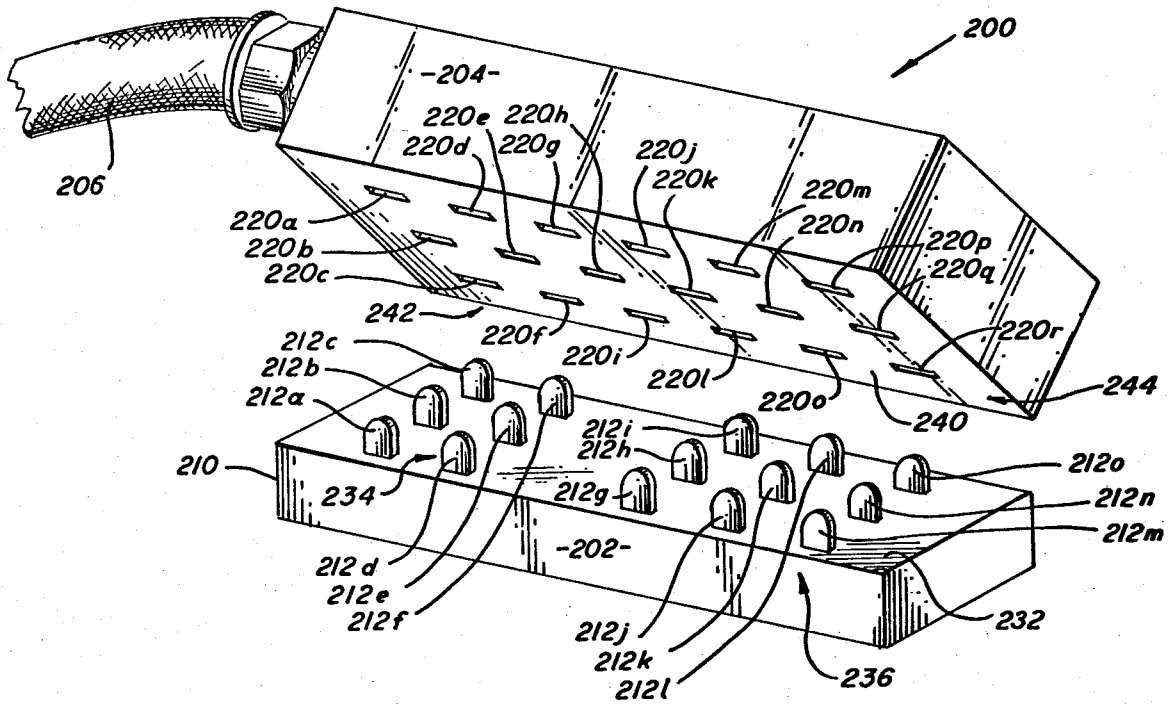
FIG. 1 is an orthognal view of an electrical connector including a socket having two longitudinally spaced positions for forming two different, electrically conductive circuits.
Figures 2, 3:
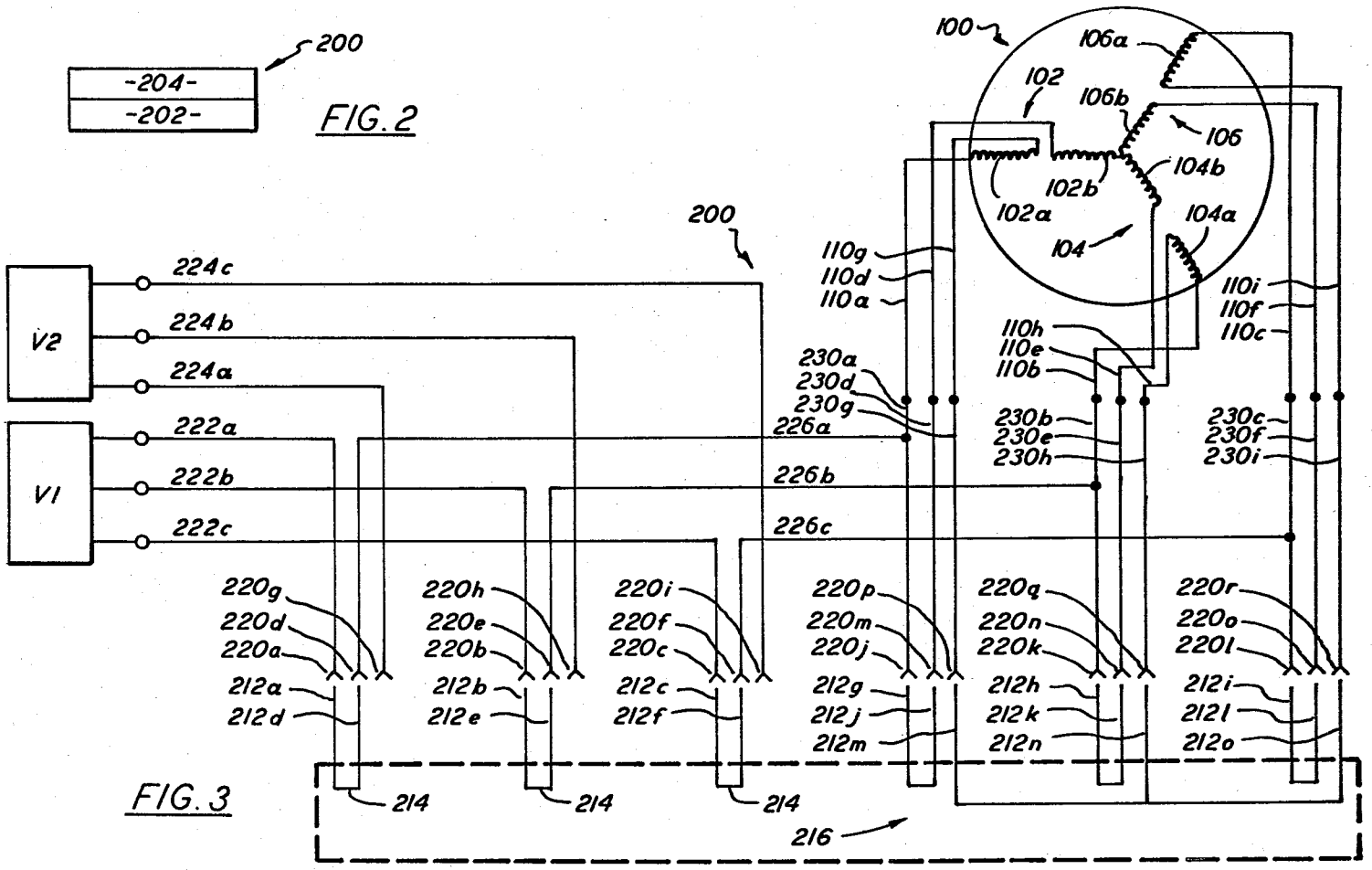
FIG. 2 is a side view of the plug and socket of the electrical connector shown in FIG. 1, with the socket shown in a first position.
FIG. 3 is a schematic view of the electric circuit formed by the electrical connector when the socket thereof is in the first position shown in FIG. 2, and also showing a three phase motor and dual voltage sources connected to the electric circuit.
Figures 4, 5:
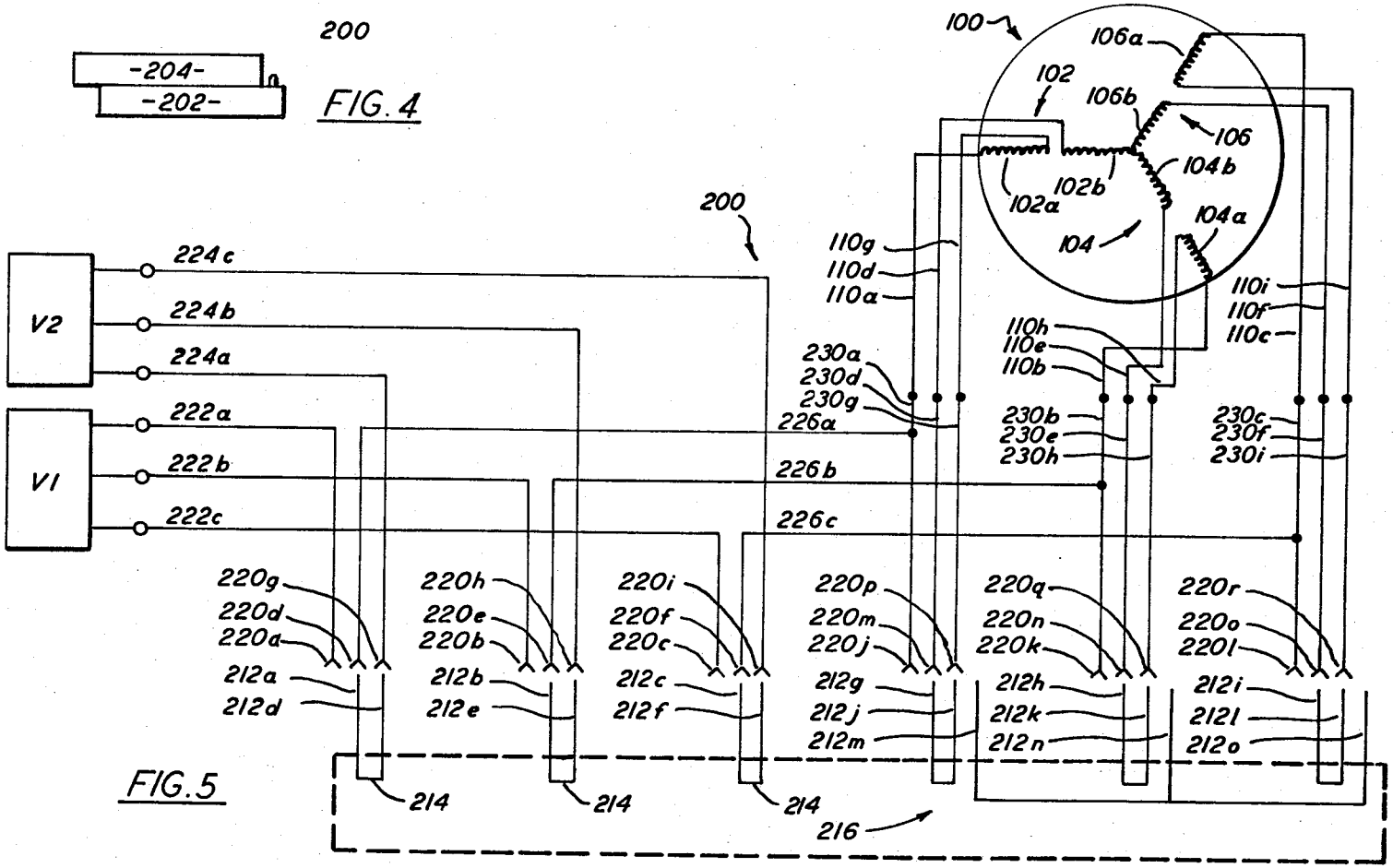
FIG. 4 is a side view of the plug and socket of the electrical connector, with the socket shown in a second position.
FIG. 5 is a schematic view of the electric circuit formed by the electrical connector when the socket thereof is in the second position shown in FIG. 4, and also showing the three phase motor and the dual voltage sources connected to the electric circuit.

Also, it should be noted that while the electrical connector of the present invention is intended for use with a multi-voltage, multi-phase electric motor, primarily the connector has wider applicability and may be used with other electric appliances or devices having first and second winding sections and a plurality of lead wires connected to the winding sections. For example, the electrical connector may be used with electric transformers or heaters. Returning to the principle use for the present invention, a motor of the type outlined above is schematically shown in FIGS. 3 and 5 and generally referenced as 100. Specifically, motor 100 is a dual voltage, three phase motor. Motor 100 may be driven by either of two, three phase voltage sources, represented in FIGS. 3 and 5 as V1 and V2. In practice, V1 provides a three phase, 220 volt alternating current; while V2 supplies a three phase, 440 volt alternating current.

Motor 100 includes three motor windings 102, 104, and 106, and each motor winding includes two separate sections a and b. With the particular motor illustrated in FIGS. 3 and 5, the motor windings are arranged in a "star" configuration, with all three windings connected to a common center and, schematically, radially extending outward therefrom. It should be pointed out that the present invention, with modifications well within the purview of those skilled in the art, may be employed with electric motors having a "delta" winding configuration, where opposite ends of each motor winding are connected in common with ends of other motor windings.

Lead wires 110*a* through 110*i* are connected to the motor winding sections of motor 100 and externally extend from the motor. More specifically, leads 110*a*, 110*b*, and 110*c* are respectively connected to the radially outside ends of motor winding sections 102*a*, 104*a*, and 106*a*. Leads 110*d*, 110*e*, and 110*f*, are respectively connected to the radially outside ends of motor winding sections 102*b*, 104*b*, and 106*b*. Motor lead wires 110*g*, 110*h*, 110*i*, are respectively connected to radially inside ends of motor winding sections 102*a*, 104*a*, and 106*a*.

Referring now to FIGS. 1 through 5, there is disclosed electrical connector 200. Connector 200 includes, generally, first connector member or plug 202 and second connector member or socket 204, and preferably further includes conduit 206. Plug 202 includes base 210, a plurality of blades 212, and first and second jumper means 214 and 216. Socket 204 defines a plurality of receptacles 220 and includes first, second, third, and fourth connecting means 222, 224, 226, and 230. As will be apparent to those skilled in the art, preferably base 210 and receptacles 220 are electrically non-conductive, while blades 212, jumper means 214 and 216, and connecting means 222, 224, 226, and 230 are all electrically conductive.

Base 210 defines a longitudinal axis; and preferably the base has a box-shape, defining a linear longitudinal axis and a planer top surface 232. Blades 212 extend outward from base 210, specifically top surface 232 thereof, and preferably all blades 212 define parallel blade axes perpendicular to top surface 232. Blades 212 are grouped into two sets: first set 234 and second set 236. Preferably, first set 234 of blades 212 comprises first and second blade rows; and second set 240 of the blades comprises third, fourth, and fifth blade rows. These rows all transversely extend across base 210 and the rows within each set of blades 212 are longitudinally spaced apart. Preferably, the first and second, the third and fourth, and the fourth and fifth blade rows are equally spaced apart, a distance defining an interrow spacing unit. In addition, preferably first 234 and second 236 sets of blades 212 are also longitudinally spaced apart, with the distance between these sets of blades being twice the interrow spacing unit defined above.

Even more particularly, the first row of blades comprises blades 212*a*, 212*b*, and 212*c*; the second row of blades includes blades 212*d*, 212*e*, and 212*f*; the third row of blades comprises blades 212*g*, 212*h*, and 212*i*; the fourth row of blades includes blades 212*j*, 212*k*, and 212*l*, and the fifth row of blades includes 212*m*, 212*n*, and 212*o*. Preferably, blades within each row are equally spaced apart; and the first, second, and third blades in each blade row are respectively aligned with the first, second, and third blades in the other blade rows.

First jumper means 214 electrically connect blades in the first set 234 thereof, and second jumper means 216 electrically connects blades in the second set 236 thereof. Specifically, first jumper means 214 connects blades 212*a* and 212*d* in series, connects blades 212*b* and 212*e* in series, and connects blades 212*c* and 212*f* in series. Second jumper means 216 connects blades 212*g* and 212*j* in series, connects blades 212*h* and 212*k* in series, connects blades 212*i* and 212*l* in series, and connects blades 212*m*, 212*n*, and 212*o* in series with a common conductor line.

Discussing socket 204 and receptacles 220 in greater detail, preferably the socket also has a box-shape, defining a longitudinal axis parallel to the longitudinal axis of base 210 and a planer bottom surface 240 parallel to surface 232 of the base. Receptacles 220 receive blades 212 and extend inside socket 204, specifically inward from bottom surface 240 thereof. Preferably, all receptacles 220 define parallel receptacle axes, which are parallel to the axes defined by blades 212. In this manner, movement of socket 204 along the blade axes, toward and away from plug 202, moves blades 212 into and out of receptacles 220. Preferably, clip or grip means (not shown) are provided within each receptacle 220 to engage frictionally any blade 212 extending therewithin and, thus, to hold plug 202 and socket 204 in secure physical and electrical contact.

Receptacles 220 are also grouped into two sets: first set 242 for receiving first set 234 of blades 212, and second set 244 for receiving second set 236 of the blades. Preferably, first set 242 of receptacles 220 comprises first, second, and third receptacle rows; and second set 244 of the receptacles comprise fourth, fifth, and sixth receptacle rows. These rows all transversely extend across socket 204 and the rows within each set of receptacles 220 are longitudinally spaced apart, preferably equally spaced apart.

Further, preferably, first 242 and second 244 sets of receptacles 220 are also longitudinally spaced apart, with the spacing between these sets of receptacles equal to the spacing between adjacent rows within the sets of receptacles.

Even more specifically, the first row of receptacles 220 includes receptacles 220*a*, 220*b*, and 220*c*; the second row of receptacles includes receptacles 220*d*, 220*e*, and 220*f*; and the third row of receptacles includes receptacles 220*g*, 220*h*, and 220*i*. The fourth row of receptacles includes receptacles 220*j*, 220*k*, and 220*l*; the fifth row of receptacles includes receptacles 220*m*, 220*n*, and 220*o*; and the sixth row of receptacles includes receptacles 220*p*, 220*q*, and 220*r*. Preferably, the receptacles within each row are equally spaced apart; and the first, second, and third receptacles in each receptacle row are respectively aligned with the first, second, and third receptacles in the other receptacle rows.

First connecting means 222 is provided for connecting first set 242 of receptacles 220 to first voltage source V1, and second connecting means 224 is provided for connecting the first set of receptacles to second voltage source V2. Preferably first connecting means 222 comprises a plurality of conductive terminals disposed within receptacles 220*a*, 220*b*, and 220*c*, and a plurality of leads 222*a*, 222*b*, and 222*c* connected to these conductive terminals and extending from receptacles 220*a*, 220*b*, and 220*c*, through socket 204 and conduit 206, and preferably terminating in a plug adapted to connect with an output plug of first voltage source V1. Similarly, second connecting means 224 preferably includes a plurality of conductive terminals disposed within receptacles 220*g*, 220*h*, and 220*i*, and a plurality of leads 224*a*, 224*b*, and 224*c* connected to these conductive terminals and extending from receptacles 220*g*, 220*h*, and 220*i*, through socket 204 and conduit 206, and preferably terminating in a plug adapted to connect with an output plug of second voltage source V2. Third connecting means 226 electrically connects first set 242 of receptacles 220 to second set 244 of the receptacles, and fourth connecting means 230 is provided for connecting the second set of receptacles to motor leads 110. In particular, preferably connecting means 226 comprises a plurality of conductive terminals disposed within receptacles 220*d*, 220*e*, 220*f*, 220*j*, 220*k*, and 220*l*, and a plurality of leads 226*a*, 226*b*, and 226*c* respectively connected to and extending between terminals located within receptacles 220*d* and 220*j*, 220*e* and 220*k*, and 220*f* and 220*l*. At the same time, fourth connecting means 230 preferably includes a plurality of leads 230*a* through 230*i* respectively connected to receptacles 220*j* through 220*r*, either via leads 226*a*, 226*b*, and 226*c* or via conductive terminals disposed within the receptacles. Leads 230*a* through 230*i* extend through conduit 206 and preferably terminate in plugs or connectors for connecting leads 230*a* through 230*i* with motor leads 110*a* through 110*i* respectively.

Socket 204 has first and second longitudinally spaced apart connected positions. In the first position, shown in FIG. 2, second set 244 of receptacles 220 receive second set 236 of blades 212 for connecting sections a and b of each motor winding 102, 104, and 106 in parallel, and first set 242 of the receptacles receive first set 234 of the blades for connecting motor 100 to first voltage source V1. In the second position, shown in FIG. 4, second set 244 of receptacles 220 receive second set 236 of blades 212 for connecting sections a and b of each motor winding 102, 104 and 106 in series, and first set 242 of the receptacles receive first set 234 of the blades for connecting motor 100 to second voltage source V2. FIGS. 3 and 5 are circuit diagrams showing the electric circuits formed by electrical connector 200 and motor 100 when socket 204 of the electrical connector is in the first and second connected positions respectively.

Particularly referring to FIG. 3, when socket 204 is in the first connected position, the first, second, fourth, fifth, and sixth rows of receptacles respectively receive the first, second, third, fourth, and fifth rows of blades—with the first, second, and third blades in the blade rows respectively received by the first, second, and third receptacles in the receptacle rows. With this arrangement, sections a and b of motor winding 102 are connected in parallel via leads 110*a*, 110*d*, 230*a*, and 230*d*, receptacles 220*j* and 220*m*, and blades 212*g* and 212*j*; sections a and b of motor winding 104 are connected in parallel via leads 110*b*, 110*e*, 230*b*, and 230*e*, receptacles 220*k* and 220*n*, and blades 212*h* and 212*k*; and sections a and b of motor winding 106 are connected in parallel via leads 110*c*, 110*f*, 230*c*, and 230*f*, receptacles 220*l* and 220*o*, and blades 212*i* and 212*l*. At the same time, motor winding 102 is connected to first voltage source V1 via leads 110*a*, 230*a*, 226*a*, and 222*a*, receptacles 220*a* and 220*d*, and blades 212*a* and 212*d*; motor winding 104 is connected to voltage source V1 via leads 110*b*, 230*b*, 226*b*, and 222*b*, receptacles 220*b* and 220*e*, and blades 212*b* and 212*e*; and motor winding 106 is connected to the first voltage source via leads 110*c*, 230*c*, 226*c*, and 222*c*, receptacles 220*c* and 220*f*, and blades 212*c* and 212*f*.

Referring now to FIG. 5, when socket 204 is in the second connected position, the second, third, fifth, and sixth rows of receptacles respectively receive the first, second, third, and fourth rows of blades—again with the first, second, and third blades in the blade rows respectively received by the first, second, and third receptacles in the receptacle rows. In this manner, sections a and b of motor winding 102 are connected in series via leads 110*d*, 110*g*, 230*d*, and 230*g*, receptacles 220*m* and 220*p*, and blades 212*g* and 212*j*; sections a and b of motor winding 104 are connected in series via leads 110*e* and 110*h*, 230*e*, and 230*h*, receptacles 220*n* and 220*q*, and blades 212*h* and 212*k*; and sections a and b of motor winding 106 are connected in series via leads 110*f*, 110*i*, 230*f*, and 230*i*, receptacles 220*o* and 220*r*, and blades 212*i* and 212*l*. At the same time, motor winding 102 is connected to second voltage source V2 via leads 110*a*, 230*a*, 226*a*, and 224*a*, receptacles 220*g* and 220*d*, and blades 212*a* and 212*d*; motor winding 104 is connected to voltage source V2 via leads 110*b*, 230*b*, 226*b*, and 224*b*, receptacles 220*e* and 220*h*, and blades 212*b* and 212*e*; and motor winding 106 is connected to the second voltage source via leads 110*c*, 226*c*, 230*c*, and 224*c*, receptacles 220*f* and 220*i*, and blades 212*c* and 212*f*.

Figure 6:
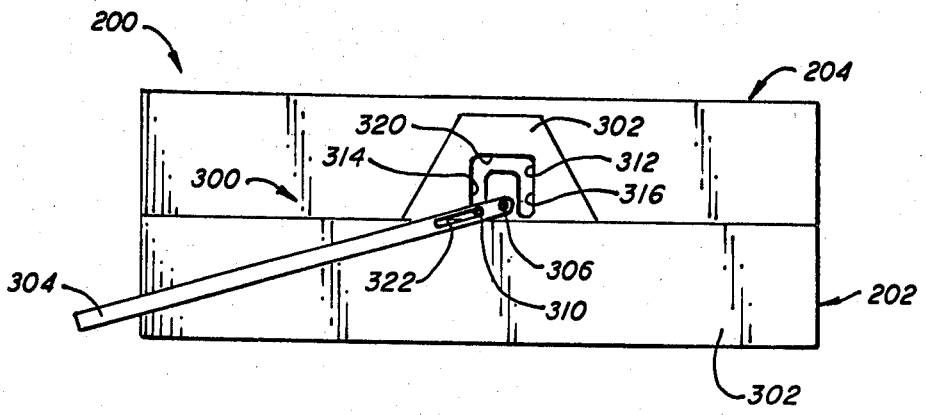
FIGS. 6 and 7 are side views of an embodiment of the electrical connector including switching means for moving the socket between the first and second positions thereof.
Figure 7:
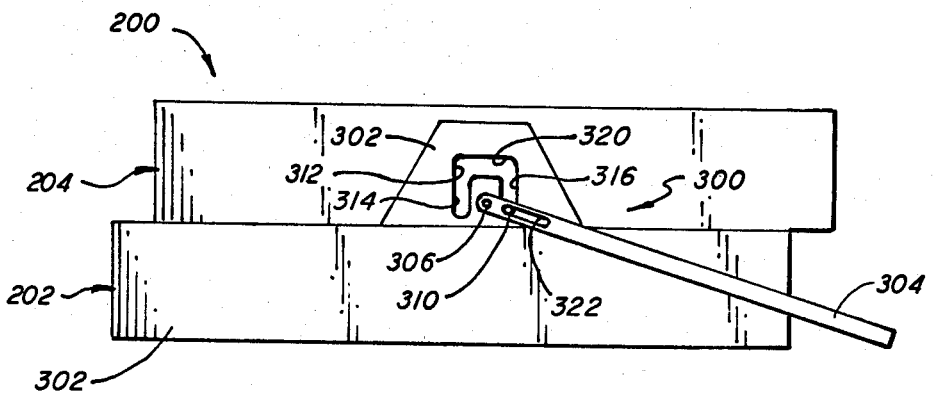

As mentioned above, under certain circumstances, it may be difficult to move socket 204 between its connected positions solely by hand. Consequently, in accordance with the present invention, electrical connector 200 is provided with switching means for moving socket 204 between its first and second connected positions, and FIGS. 6 and 7 illustrate an embodiment of the electrical connector including switching means 300 for so moving the socket. More specifically, switching means 300 is secured to plug 202 and may be used to move socket 204 away from the first connected position thereof along the blade axes defined by blades 212, then along the longitudinal axis of plug 202, and then back again along the blade axes toward and into the second connected position. Similarly, as will be apparent, switching means 300 may also be employed to move socket 204 away from the second connected position thereof along the blade axes defined by blades 212, then along the longitudinal axis of plug 202, and then back again along the blade axes toward and into the first connected position.

The embodiment of switching means 300 shown in FIGS. 6 and 7 includes, generally, plate 302, handle 304, handle connecting means 306, socket connecting means 310, and guide means 312. Preferably, handle connecting means 306 includes a pivot pin, socket connecting means 310 includes a connecting pin, and guide means 312 includes a guide slot defined by plate 302, and preferably this guide slot comprises first and second legs 314 and 316 and intermediate portion 320.

Plate 302 is connected to plug 202, specifically to a side thereof; and the plate projects above top surface 232 of the plug, adjacent and parallel to a side of socket 204. Guide means 312 is provided for guiding movement of socket 204 between the first and second connected positions. As mentioned above, preferably guide means 312 comprises a guide slot, including legs 314 and 316 and intermediate portion 320, defined by plate 302. More particularly, legs 314 and 316 of guide slot 312 are parallel and spaced apart, and intermediate portion 320 of the guide slot extends between first, or upper, ends of these legs, generally perpendicular thereto. Further, in assembly, plate 302 is positioned with second, or lower ends of legs 314 and 316 adjacent top surface 232 of plug 202, with the longitudinal axes of the legs substantially parallel to the blade axes defined by blades 212 (only shown in FIG. 1), and with the longitudinal axis of intermediate portion 320 generally parallel to the longitudinal axis of plug 202.

Connecting means 306 connects handle 304 to plate 302 for movement between first and second handle positions. Preferably, pin 306 pivotally connects handle 304, specifically a first end thereof, to guide plate 302, specifically to a central area thereof between legs 314 and 316 and below intermediate portion 320 of guide slot 312. Handle 304 is, hence, supported for pivotal movement between a first position, for example as shown in FIG. 6, and a second position, for example as shown in FIG. 7. Handle 304, preferably a portion of the handle adjacent the first end thereof, defines handle slot 322; and the length of the handle slot is chosen so that, as the handle moves or pivots between its first and second positions, the handle slot always projects over guide slot 312. Connecting means 310 connects socket 204 to handle 304 for movement therewith. Preferably, as mentioned above, connecting means 310 includes a pin. Pin 310 is secured to socket 204 and extends through guide slot 312 and handle slot 322. Pin 310, hence, moves with handle 304. At the same time, however, connecting pin 310 is constrained to move within guide slot 312.

With the above described switching means 300, as handle 304 pivots between its first and second positions, the handle pulls connecting pin 310 and, thus, socket 204 with it. Since pin 310 is constrained to move within guide slot 312, pin 310 and socket 204 are first moved away from plug 202 along leg 314 of the guide slot, and thus parallel to the blade axes defined by blades 212. The length of legs 314 and 316 of guide slot 312 is chosen so that, when connecting pin 310 is at the first or upper end of a leg, receptacles 220 are clear of blades 212.

When connecting pin 310 reaches the upper end of leg 314, further movement of handle 304 toward its second position now pulls the connecting pin along intermediate portion 320 of guide slot 312. Socket 204, which is pulled with connecting pin 310, is thus moved along the longitudinal axis of plug 202 from a position directly above the first connected position of the socket; and the length of intermediate portion 320 of guide slot 312 is chosen so that as pin 310 reaches the end of intermediate portion 320 and enters leg 316, socket 204 is directly above the second connected position of the socket.

Continued movement of handle 304 into its second position now pulls pin 310 within leg 316 of slot 312, toward the lower end of leg 316. Socket 204 moves toward plug 202 along the longitudinal axis of leg 316, and hence parallel to the axes of blades 212. Receptacles 220 are brought into secure engagement with blades 212, bringing socket 204 into its second connected position.

Depending upon a number of factors such as variations in the frictional forces between individual blades 212 and receptacles 220, as socket 204 is pulled away from either its first or second connected positions, one end of the socket may tend to move away from plug 202 before and to a greater extent than the other end of the socket; and under certain conditions, the latter end of the socket may not become completely free of blades 212. For this reason, electrical connector 200, specifically switching means 300 thereof, may be provided with leveling means to maintain the longitudinal axes of plug 202 and socket 204 substantially parallel as the socket moves between its first and second positions. A first leveling means is shown in FIGS. 8, 9 and 10, and a second leveling means is shown in FIGS. 11 and 12.

Turning to FIGS. 8, 9 and 10, the embodiment of switching means disclosed therein is very similar to the embodiment of the switching means described above, including plate 302, handle 304, connecting pins 306 and 310, guide slot 312, and handle slot 322. The switching means 300 shown in FIGS. 8, 9 and 10 also includes leveling means 340. Leveling means 340, in turn, comprises a pair of first links **342*a* and 342*b*, a pair of second links 344*a* and 344*b*, and connecting pins 346, 350, and 352. Also, with this embodiment of electrical connector 200, plate 302 defines pivot pin slot 354, and preferably the side of socket 204 defines leveling slots 356**.

More particularly, pivot pin 306 extends through pivot pin slot 354 and is movable therewithin, and first links **342*a* and 342*b* are pivotally connected to pivot pin 306. Pins 346 pivotally connect first ends of second links 344*a* and 344*b* to first links 342*a* and 342*b*, pins 350 pivotally connect second ends of the second links to socket 204, and pins 352 pivotally connect intermediate portions of the second links to plug 202. Leveling slots 356 are defined by portions of socket 204 adjacent second ends of second links 344***a* and 344*b*, and preferably pins 350 extend within the leveling slots and are movable therewithin. Preferably, the longitudinal axis of pivot pin slot 354 is perpendicular to the longitudinal axis of plug 202, and the longitudinal axes of leveling slots 356 are parallel to the longitudinal axis of socket 204.

With the above-discussed arrangement, any tendency of either end of socket 204 to pivot toward or away from plug 202 is transmitted to the other end of the socket to maintain both ends level. For example, as viewed in FIGS. 8, 9 and 10, upward movement of the left end of socket 204 pivots link 344*a* about the pin 352 connecting that link to plug 202. This pulls link 342*a* downward, and this pulls pivot pin 306 downward within pivot pin slot 354. This, in turn, forces first link 342*b* downward, this pivots second link 344*b* about the pin 352 connecting that link to plug 202, and this forces the second end of link 344*b* upward. Pin 350 is forced upward, forcing the right end of socket 204 to stay level with the left end thereof.

Particularly referring now to FIGS. 11 and 12, with the embodiment of electrical connector 200 disclosed therein, leveling means 340 includes sleeve means 360, connecting link 362, pivot links 364*a* and 364*b*, and connecting pins 366 and 370. Sleeve means 360 is secured to the side of socket 204 and longitudinally extends therealong parallel to the axes of both the socket and plug 202. As will be apparent, any suitable sleeve means 360 may be employed with the present invention. For example, sleeve means 360 may comprise a U-shaped channel, with the opposed legs of the channel secured to socket 204 and the base of the channel slightly spaced therefrom. Connecting link 362 longitudinally extends within sleeve means 360 in a close, sliding fit therewith. Sleeve means 360 and socket 204 are, hence, longitudinally movable relative to connecting link 362, however the connecting link, the sleeve means, and the socket all move substantially unitarily toward and away from plug 202. Connecting pins 366 pivotally connects first ends of pivot links 364*a* and 364*b* to connecting link 362, preferably to opposed longitudinal ends thereof and pins 370 pivotally connect second ends of pivot links 364*a* and 364*b* to plug 202. In assembly, pivot links 364*a* and 364*b* are parallel to each other and the distance between the connecting pins 366 and 370 associated with link 364*a* is equal to the distance between connecting pins 366 and 370 associated with link 364*b*. Links 364*a* and 364*b* and connecting link 362 thus form three sides of a flexible parallelogram.

With this embodiment of leveling means 340, as socket 204 moves between its first and second positions, sleeve means 360 is free to slide longitudinally along connecting link 362, allowing socket 204 to move between its first and second positions. However, pivot links 364*a* and 364*b* force connecting link 362 to remain parallel to the longitudinal axis of plug 202, thus forcing the longitudinal axes of sleeve means 360 and socket 204 also to remain parallel to the longitudinal axis of plug 202.

It should be noted that in all of the embodiments of electrical connector 200 described above, the connector may be provided with a pair of switching means 300, one on each of opposite sides of the connector. That is, connector 200 may be provided with a pair of plates 302, a pair of handles 304, a pair of each connecting means 306 and 310, and a pair of guide means 312, as well as a pair of leveling means 340. In such a case, the handles 304 may, in combination, be comprised of an elongated U-shaped bracket, with opposed legs of the bracket connected to opposite plates 302, and socket connecting means 310 may comprise a single rod transversely extending completely through socket 204.

Moreover, the intermediate portions of handles 304 and the ends thereof spaced from handle connecting means 306 may transversely bend or bow outward, away from the sides of plug 202 and socket 204, providing clearance between the handles and any leveling means 340 employed with electrical connector 200. It should also be pointed out that, when switching means 300 is used with connector 200, preferably socket 204 is provided with a pair of opposite side plates to reinforce the socket and to support securely socket connecting means 310 and any leveling means connected to the socket. Further, pins 306, 310, 346, 350, 352, 366, and 370 may all be provided the retaining means such as snap rings or end bolts to maintain the pins in place during operation of connector 200 and switching means 300.

While it is apparent that the invention herein disclosed is well calculated to fulfill the objects stated above, it will be appreciated that numerous modifications and embodiments may be devised by those skilled in the art, and it is intended that the appended claims cover all such modifications and embodiments as fall within the true spirit and scope of the present invention.

What is claimed is:

1. An electrical connector comprising:

a first connector member defining a longitudinal axis;

a second connector member movable between a first position forming a first electrically conductive circuit with the first connector member, and a second position longitudinally spaced from the first position and forming a second electrically conductive circuit with the first connector member;

wherein a selected one of the first and second connector members includes a plurality of outwardly extending blades defining parallel blade axes, and the other one of the first and second connector members defines a plurality of receptacles receiving the blades and defining receptacle axes parallel to the blade axes;

switching means including a plate secured to the first connector member, a handle, means connecting the handle to the plate for movement between first and second handle positions, and means connecting the second connector member to the handle for moving the second connector member along the blade axes away from the first position, then along the longitudinal axis of the first connector member, and then along the blade axes toward and into the second position and means for guiding movement of the second connector member between the first and second positions thereof.

2. The electrical connector as defined by claim 1 wherein:

the guiding means includes a guide slot defined by the plate;

the means connecting the handle to the plate includes a pivot pin pivotally connecting the handle to the plate;

the handle defines a handle slot; and the means connecting the handle to the second connector member includes a connecting pin secured to the second connector member and extending through the guide slot and the handle slot, wherein movement of the handle moves the connecting pin within the guide slot.

3. The electrical connector as defined by claim 2 wherein the guide slot includes first and second legs for guiding movement of the second connector member toward and away from the first connector member, and an intermediate portion extending between the first and second leg portions for guiding movement of the second connector member along the longitudinal axis of the first connector member.

4. The electrical connector as defined by claim 3 wherein:

the first and second legs of the guide slot define longitudinal axes substantially parallel to the blade axes; and the intermediate portion of the guide slot defines a longitudinal axis substantially parallel to the longitudinal axis of the first connector member.

5. The electrical connector as defined by claims 1 or 3 wherein the second connector member defines a longitudinal axis, and further comprising leveling means to maintain the longitudinal axes of the first and second connector members substantially parallel as the second connector member moves between the first and second positions thereof.

6. The electrical connector as defined by claim 5 wherein the leveling means includes:

longitudinally extending sleeve means secured to the second connector member;

a connecting link longitudinally extending through the sleeve means in a close, sliding fit therewith wherein the sleeve means and the second connector member are longitudinally movable relative to the connecting link, and the connecting link, the sleeve means, and the second connector member move substantially unitarily along the blade axes; and a pair of pivot links;

means pivotally connecting first ends of the pivot links to the first connector member;

means pivotally connecting second ends of the pivot links to the connecting link to maintain the connecting link parallel to the longitudinal axes of the first and second connector members.

7. The electrical connector as defined by claims 2 or 3 wherein:

the second connector defines a longitudinal axis;

the plate defines a pivot pin slot, and the pivot pin extends through and is movable within the pivot pin slot; and further comprising leveling means to maintain the longitudinal axes of the first and second connector members substantially parallel as the second connector member moves between the first and second positions thereof, the leveling means including a pair of first links pivotally connected to the pivot pin, a pair of second links, means pivotally connecting first ends of the second links to the first links, means pivotally connecting second ends of the second links to the second connector member, and means pivotally connecting intermediate portions of the second links to the first connector member.

8. The electrical connector as defined by claim 7 wherein:

the second connector member defines a pair of leveling slots; and the means pivotally connecting the second links to the second connector member includes a pair of leveling pins connected to the second links and extending through the leveling slots.

9. The electrical connector as defined by claim 8 wherein the pivot pin slot defines a longitudinal axis substantially parallel to the blade axes.

* * * * *